United States Patent [19]

Veneruso

[11] Patent Number: 5,030,950

[45] Date of Patent: Jul. 9, 1991

[54] SWITCHED CAPACITANCE METER READING DEVICE

[75] Inventor: John E. Veneruso, Fort Worth, Tex.

[73] Assignee: Siecor Corporation, Hickory, N.C.

[21] Appl. No.: 425,702

[22] Filed: Oct. 23, 1989

[51] Int. Cl.[5] ..... G08C 19/10

[52] U.S. Cl. ..... 340/870.370; 364/480; 364/556; 340/870.020

[58] Field of Search ..... 340/870.02, 870.07, 340/870.37; 324/660; 364/480, 556

[56] References Cited

U.S. PATENT DOCUMENTS

| | | | |
|---|---|---|---|
| 4,007,454 | 2/1977 | Cain et al. | 340/870.37 |
| 4,165,505 | 8/1979 | Cain et al. | 340/870.37 |
| 4,429,308 | 1/1984 | Shankle | 340/870.02 |
| 4,433,332 | 2/1984 | Wason | 340/870.37 |
| 4,477,860 | 10/1984 | Wason | 340/870.37 |
| 4,556,844 | 12/1985 | Wason | 340/870.02 |
| 4,606,008 | 8/1986 | Wason | 340/870.37 |
| 4,743,902 | 5/1988 | Andermo | 340/870.01 |
| 4,779,094 | 10/1988 | Lee et al. | 340/870.37 |
| 4,924,407 | 5/1990 | King et al. | 340/870.37 |

OTHER PUBLICATIONS

Microelectronics Digital & Analog Circuits and Systems, Jacob Millman, Mcgraw-Hill Publishers, 12/1979.

Motorola Linear Integrated Circuits, Series C, 12/1979.

IC Op-Amp Cookbook, by Walter G. Jung, Howard W. Sams & Co., Inc., 12/1974.

Electronic Devices and Circuits, Discrete and Integrated, M. S. Ghausi, Holt, Rinehart and Winston, 12/1985.

*Primary Examiner*—Donald J. Yusko

*Assistant Examiner*—Yuk H. Lau

*Attorney, Agent, or Firm*—Roy B. Moffitt

[57] ABSTRACT

An apparatus for remotely monitoring the position of a rotatable member, relative to a substrate spaced apart from the rotatable member, as the rotatable member is rotated about an axis of rotation by an axle, including an array of spaced-apart, outer electrodes delimiting a center portion, a center electrode in the center portion and first and second transistors in contact with the center electrode; each outer electrode is in contact with a transistor used to selectively connect an outer electrode to ground; the first transistor, when turned on, supplies current to the center electrode to form a charge to a capacitor formed by the center electrode, rotatable member, and predetermined outer electrode, and the second transistor, when turned on, supplies current proportional to the formed charge to a current-to-voltage converter; a clock is connected to and controls the first and second transistors, turning them on and off so that when one is off and the other is on, in a repetitive cycle; the average voltage output of the current-to-voltage converter is proportional to the capacitance formed by the center electrode, rotatable member, and the predetermined outer electrode and the converter's output is connected to a low-pass filter, the voltage output of the low-pass filter is compared to one or more fixed voltage references by a comparator, which generates an output voltage that reflects the results of the comparison and, a microprocessor scans the output of the comparator, changes the fixed reference to another value if there is more than one, selects the outer electrodes one at a time, and determines the rotational position of the rotatable member.

9 Claims, 5 Drawing Sheets

SWITCHED CAPACITANCE METER READING DEVICE

BACKGROUND OF THE INVENTION

This invention relates to a humidity and temperature resistant apparatus for determining the orientation of a rotatable meter hand relative to a dial spaced apart from a meter hand. More particularly, the invention is concerned with the creating and depleting a charge between a center electrode, meter hand, and an outer electrode (a pad) very rapidly to generate a current that is applied to a current-to-voltage converter, whose output is compared, by a comparator, against one or more fixed voltage reference values. A microprocessor is used to control the selection of the outer electrodes, choose a fixed voltage reference to be applied to one of the comparator's inputs and store the comparator's output state for future reference.

GENERAL DESCRIPTION OF THE PRIOR ART

A prior art remote meter reading device (see FIG. 3), sold by Siecor Corporation under Part Number SE200, uses a high pass filter technique, otherwise known as a transimpedance amplifier to sense the position of a meter's hand. Once this is done, it encodes the reading and sends it over a cable in ASCII form to an interface device, like a TIU-100 (Telephone Interface Device also sold by Siecor Corporation) where the reading can be used for monitoring power usage and customer billing. It employs a four-layer PC Board (see FIG. 1) and a microprocessor, analog and digital circuitry and five dial-pad (excitable electrodes) arrangement (see FIG. 2). Each encoder dial is made up of ten pads (excitable electrodes), arranged around an inner ring, each pad coinciding with one of the ten meter hand positions. The excitable electrodes or pads and inner ring are made of copper PC board metallization connected to electronic circuitry. To sense the position of the meter hand, a pulse or waveform is generated and routed to a predetermined one of the ten pads on the dial being tested. If the meter hand of this predetermined dial is located over the pad being tested, it acts like an antenna, i.e., it receives the signal sent to the pad, conducts it down its length toward the center of the dial and transmits it to the nearby inner ring (center electrode), which is spaced apart from the pad by five to twenty-five thousandths of an inch. The meter hand can also be looked upon as the middle plate of a three-plate capacitor, the other plates being the dial's pad and its inner ring. When the meter hand is over the pad being excited, the capacitor formed conducts the high frequency pulses to the inner ring (center conductor) while sharply attenuating lower frequencies, most of which are noise. Since the capacitance thus formed is small, the frequency corner (frequencies below the corner are attenuated and frequencies above the corner are passed) created by the capacitance and the first stage of an amplifier connected thereto is approximately 159KHz. When the meter hand is not present, the frequency corner is approximately 640KHz. When a meter hand is not over the pad being excited, only stray capacitance exists, through the PC board and the relatively long air path from the pad to the inner ring center conductor. This prior art encoder makes use of the difference in frequency corners by sending a signal of approximately 130lKHz to 175KHz to the pad being measured or analyzed. If the meter hand is not there, the resultant signal output by the first stage of the high performance wide bandwidth amplifier is very small. If the meter hand is over the pad, the resultant signal is relatively large.

The above-identified prior art device employs a high pass filter or transimpedance measurement technique. Under some circumstances, this technique works best if used in coordination with at least one operational amplifier (op-amp) per dial because (a) the signal that is passed through such a small capacitance, like that of an excitable electrode center electrode and meter hand, before being amplified is weak and thus difficult to be routed first through any other devices such as a multiplexer, and (b) a microprocessor used with the prior art device senses only one dial at a time because, for cost reasons, all like numbered pads on the five dials are connected together. In addition to the one op-amp per dial, an additional one or more amplifying stages are required to boost the signal up to measurable levels. The total power available to run the prior art encoder is limited to five milliamps at five volts. Because of noise and sometimes encountered non-ideal temperature characteristics (above 70° C.) of some low power op-amps, the processed signal must be sampled using an eight-bit Analog to Digital Integrated circuit or compared with an eight-bit Digital to Analog voltage level. This causes several levels of resolution to be required by the microprocessor in order to decide whether the meter hand was over the pad being excited or not.

At high temperatures (above 70° C.) reading failures have been experienced in some prior art apparatus. At these temperatures, the signal emitted when the meter hand is over a pad and when the meter hand is not over a pad are almost the same. This problem may be corrected by adding additional high performance op-amps to process the signal and setting their individual signal gains lower. Such high performance op-amps are expensive and sometimes difficult to obtain. In some instances, three amplifier stages are required to boost the signal to a point where the frequency corner difference can be measured. A total of seven high performance amplifiers have been used in prior art apparatus for five electric meter dials, assuming that a multiplexer is used after the first stage of amplifiers and before the remaining two amplifiers and an Analog to Digital converter is used to digitize the results.

The prior art SE200 encoder is a practical and workable circuit, but a large number of analog components are required and the PC Board must be carefully routed to limit electrical noise that could interfere with encoding. However, using the technique and apparatus disclosed herein, a number of analog components and amplifiers can be eliminated and reliable high temperature performance, above 70° C., can be obtained. It is sometimes desirable that operation at these high temperatures be achieved, e.g., use of encoders in glass dome enclosed electric meters in the Southwest United States where temperatures are observed in excess of 70° C.

DETAILED DESCRIPTION OF PRIOR ART APPARATUS

Shown by element 1 of FIG. 1, is a cross sectional view of an excitable electrode pad array forming a part of the previously identified prior art Siecor SE200 Encoder. It has a center electrode 2 and guard 3, all on the same surface, disposed between a meter dial face and a rotatable meter hand. Element 1 of FIG. 2 is a plan view of the cross sectional view shown in FIG. 1. Element 6 is a meter backboard and on top of the meter backboard is element 7, a meter dial face. Disposed over meter dial face 7 is plate 8, a substrate. Meter dial face 7 and substrate 8 can be combined on one substrate. On the uppermost surface of substrate 8, there is disposed center electrode 2, guard 3 and center electrode 2. It will be noted that center electrode 2 at least partially circumscribes axle 5 and is spaced apart from axle 5. Spaced apart from center electrode 2 is guard member 3 and spaced apart from guard member 3 is the electrode array 4-1 through 4-10. Note like element numbers of FIG. 2. Excitable electrodes 4-1 through 4-10 represent the ten readable positions that can be read by the encoder. Attached to axle 5 and rotatable about axle 5 is hand 9-10. It will be noted that metal portion of hand 9-10 (the under surface) is spaced apart from axle 5 and its uppermost portion is coated by a plastic or a dielectric 10.

Referring now to the prior art electrode array of FIG. 2, electronic guard 3 is connected to a constant DC voltage (not shown) through leads, X and Z. Lead Y transmits current from center electrode 2 to process circuitry, like that of FIG. 3.

Reference is now made to FIG. 3, showing a prior art encoder circuit (process circuitry). Element 21 is a square wave generator and is connected through leads 22, 23, and 24 and to dials 7, of which there are five in number and have a structure like that of FIGS. 1 and 2. Through leads 25, dials 7 are connected to multiplexer 12. In some instances, amplifiers (op-amps) 11 are inserted between dial 7 and multiplexer 12 as shown. Each dial is connected through leads 26 and 27, to DC reference voltage 20, and to transimpedance amplifier 13 via lead 27. Multiplexer 12 is connected to transimpedance amplifier 13 by lead 28. Bandpass filter 14 is connected through lead 29 to transimpedance amplifier 13. Peak-to-peak detector 15 is connected to bandpass filter 14 through lead 30. Analog to digital converter 16 is connected to the peak-to-peak detector 15 by lead 40 and to microprocessor 17 through lead 41. Smart box 18, a transmitter and receiver, is connected to microprocessor 17 through lead 42 and through lead 43 to central office 19.

The above-described circuit of FIG. 3 works as follows: The transmitter-receiver (smart-box) 18 is adapted to receive a signal from central office 19 and is responsive to the signal to activate the microprocessor 17 to control the AC voltage source 21 so that any given electrode 4-1 to 4-10 of any given dial may be excited upon command. When hand 9-10 is over electrode 4-6 (note FIG. 1), a capacitance is created and proportional current flows off of the center electrode 2, greater than there would have been in the absence of a hand 9-10. DC reference voltage source 20 supplies a steady DC bias voltage (E) to each guard member 3, associated with each dial by means of leads X and Z. By means of transimpedance amplifier 13, voltage (E) is applied to each central electrode. The DC reference voltage source 20 also supplies voltage (E) to the non-inverting input port of the transimpedance amplifier 13. Because of the virtual ground characteristics of transimpedance amplifier 13, the inverting output port of transimpedance amplifier 13 is held essentially at voltage (E). Thus, the negative input port of transimpedance amplifier 13 is at the same voltage as the non-inverting input port.

Multiplexer 12, under the control of microprocessor 17, determines which current from which central electrode of which dial is allowed to pass onto lead 28. This current (IX) is the current created by the charge existing between the excited electrode central electrode and hand 9-10. Obviously, IX is changing as the dial hand moves. Current IX passes on to lead 28 through transimpedance amplifier 13, which converts such a current into a low voltage (EX), such voltage arising out of the capacitance coupling of the dial hand and the excited electrode. E is the constant bias voltage applied to the non-inverting input port of transimpedance amplifier 13. The sum of these two voltages appear on lead 29. Band pass filter 14 is used to filter out any noise and the sum of EX plus E, minus the noise, appears on lead 30. Peak-to-peak detector 15 strips out the voltage associated with bias voltage E and converts it to an equivalent analog DC voltage denoted EXPP. Such voltage is the function of the capacitance coupling of meter hand 9-10, center electrode 2, and its associated excited electrode and appears at the analog digital converter 16, which converts it to a microprocessor usable digital word. This digital word is read by a microprocessor 17 and is stored until the same process is performed for all 50 excitable electrode-center electrode pairs, ten pairs per dial and five dials. Microprocessor 17 then processes this information to determine the five dial hand positions (ten positions possible for each dial) for the meters previously described and subsequently transmits this "meter reading" to the "smart box" 18 via lead 42, which in turn transmits the "meter reading" to the central office 19 by means of lead 43.

The instant invention does away with the necessity of amplifiers 11, transimpedance amplifier 13 and band pass filter 14, peak-to-peak detector 15, analog to digital converter 16, guard 3, and square wave generator 21.

BRIEF DESCRIPTION OF THE INVENTION

The invention is an apparatus for remotely monitoring the position of a rotatable member, relative to a substrate spaced apart from the rotatable member, as the rotatable member is rotated about an axis of rotation by an axle. The apparatus includes an array of spaced-apart, outer electrodes disposed on the substrate facing the rotatable member delimiting a center portion, a center electrode on the substrate in the center portion, first and second transistors in contact with the center electrode. Each outer electrode is in contact with a transistor used to selectively connect an outer electrode to ground. The first transistor, when turned on, supplies current from power to the center electrode to form a charge to a capacitor formed by the center electrode, rotatable member, and predetermined outer electrode, and the second transistor, when turned on, supplies current proportional to the formed charge to a current-to-voltage converter. A dual phase clock is connected to and controls the first and second transistors, turning them on and off such that one is off and the other is on, in a repetitive cycle. The average voltage output of the current-to-voltage converter is proportional to the capacitance formed by the center electrode, rotatable member, and the predetermined outer electrode. The current-to-voltage converter's output is connected to a low-pass filter, which is used to smooth and average the voltage output of the current-to-voltage converter over time and attenuate switching noise. The voltage output of the low-pass filter is compared to one or more fixed voltage references by a comparator, which generates an output voltage that reflects the results of the comparison. The voltage output of the low-pass filter is proportional to the capacitance formed by the center electrode, rotatable member, and the predetermined outer electrode, so that a relatively large capacitance corresponds to a low pass filter output voltage that is higher than the fixed comparator's reference, and a small capacitance corresponds to a low pass filter output voltage that is lower than the fixed comparator's reference. A microprocessor is used to scan the output of the comparator, change the fixed reference to another value if there is more than one, select the outer electrodes one at a time, and determine the rotational position of the rotatable member.

DETAILED DESCRIPTION OF THE INVENTION

Figure 3:
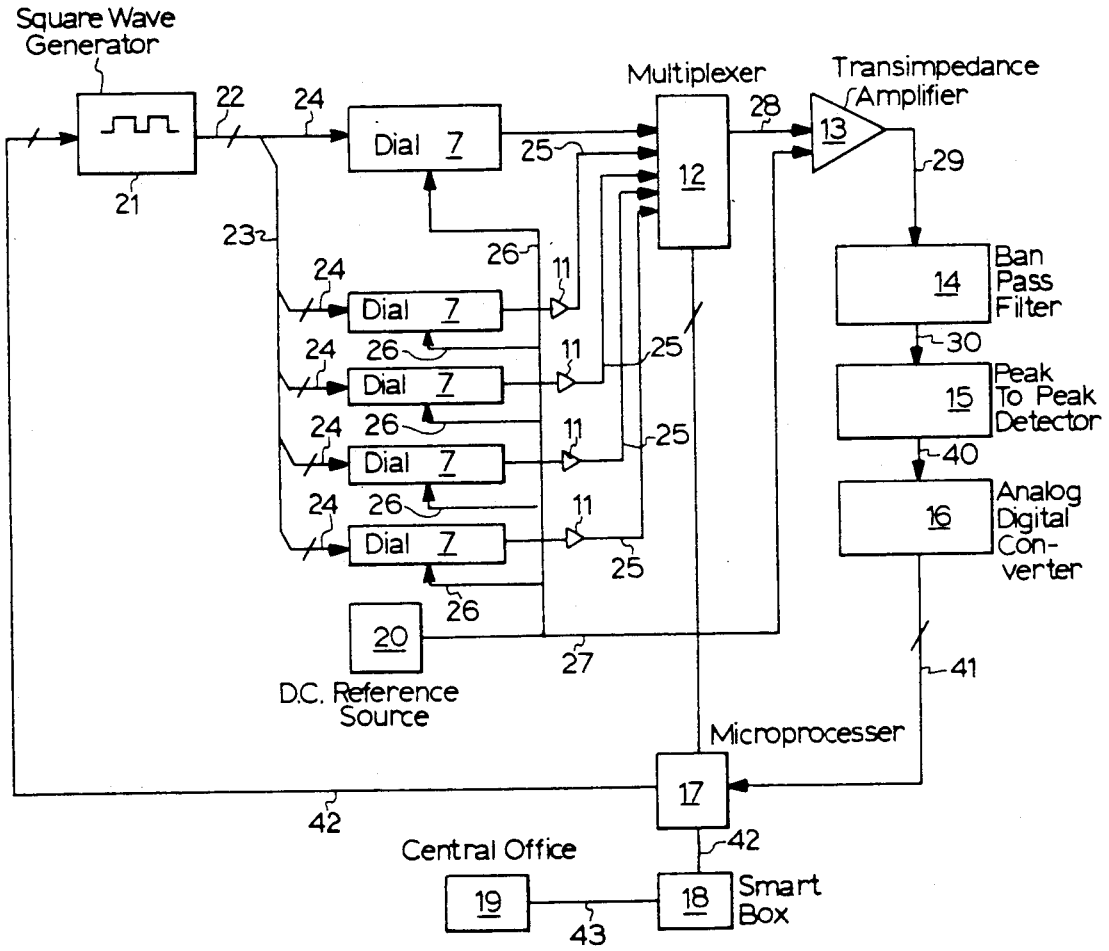
FIG. 3 PRIOR ART
FIG. 3 is a schematic representation of the circuitry employed by prior art encoders.
Figure 4:
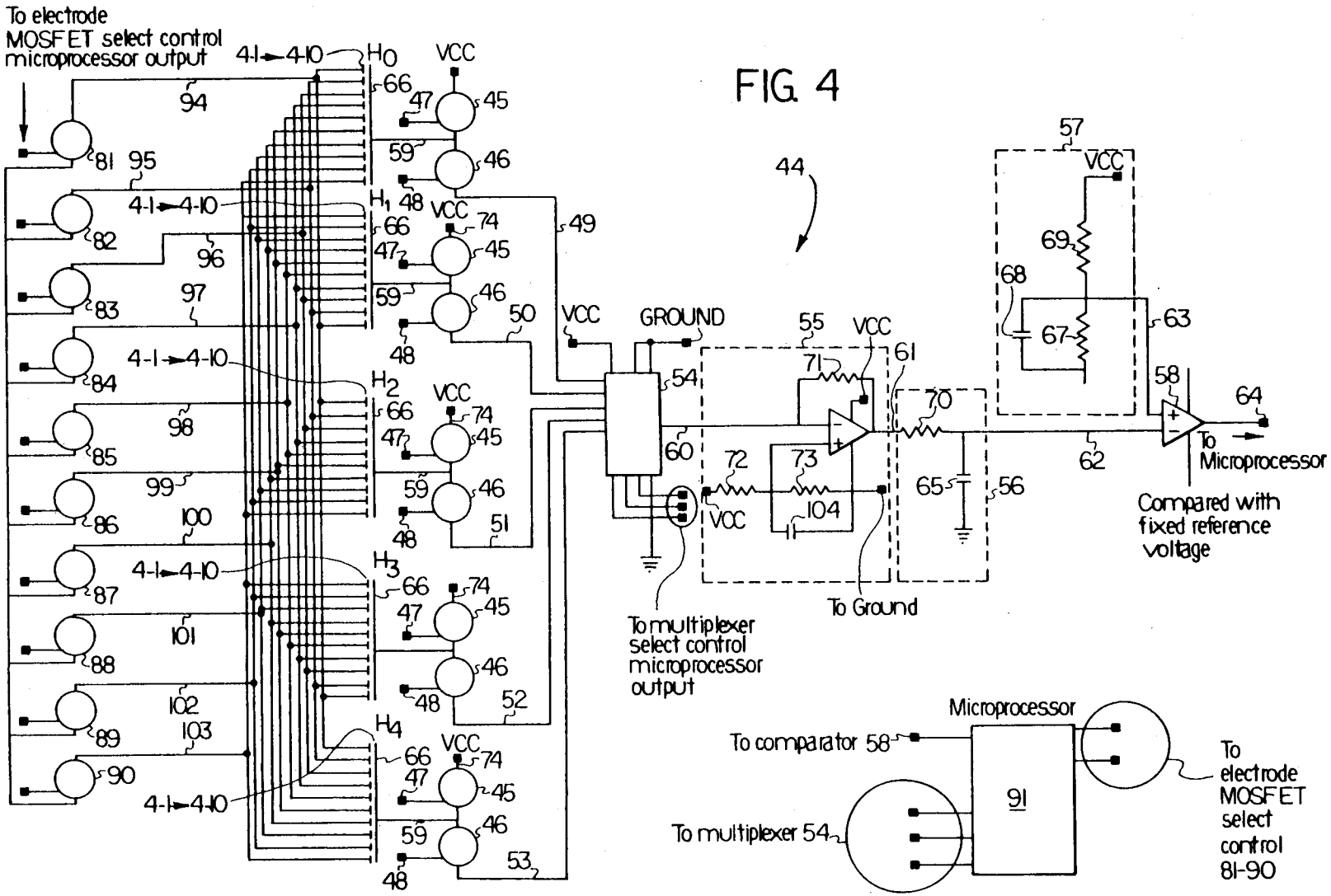
FIG. 4 is a schematic representation of the invention.
Figure 5:
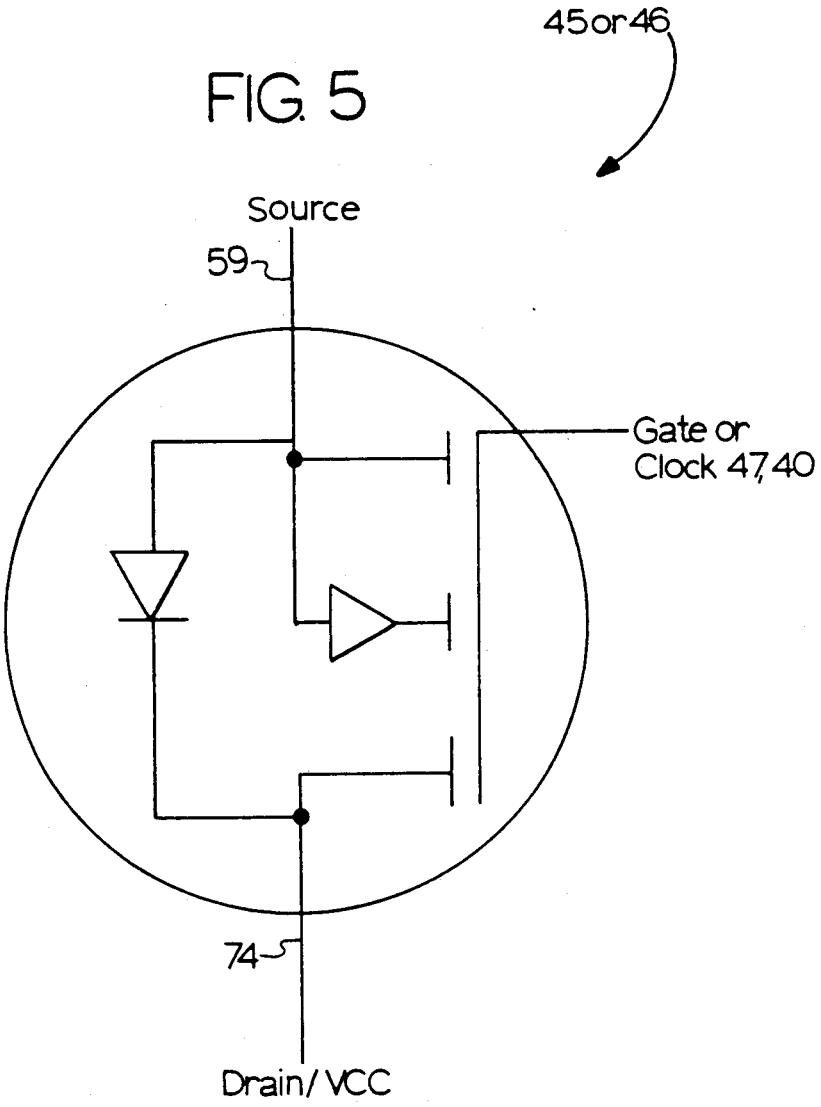
FIG. 5 is an enlarged schematic representation of transistors 45 and 46 of FIG. 4.

The invention is shown in FIG. 4 has advantages over the prior art, of reduced complexity, lower cost, increased stability at high temperatures and an immunity from noise. through 4-10 (outer electrodes), inner ring (center electrode 2), and dial hand 9-10 is used not to transmit a high frequency signal like the circuit shown in FIG. 3, but instead is charged and discharged to transport electrons, which causes current (subsequently converted into a voltage) to charge another capacitor located in a low-pass RC filter. First and second MOSFETS, (transistors) 45 and 46 and pads 4-1 through 4-10, dial hand 9-10, inner ring (center electrode 2) in combination form a simulated resistor. For small capacitances of this simulated resistor, when hand 9-10 is absent for example, the resistance is high and for large capacitances, the resistance is low. Such capacitance resistor is measured using an inexpensive, small bandwidth amplifier, resulting in a constant analog voltage level corresponding to the size of the variable capacitor.

When meter hand 9-10 is not over an electrode or pad being selectively grounded and tested, such a configuration results in the smallest capacitance that can exist. This is a baseline case and does not change much due to humidity since the substrate (PC board) is made of FR-4 material, which is fairly resistant to moisture retention. The simulated resistance is also temperature insensitive. FR-4 PC boards are a laminate of copper and resin impregnated glass fiber, the resin being primarily Bisphenal-A-Tetrapromo Visphenol-A resin available from General Electric Company. Temperature variations do not affect the switching performance of the MOSFETs 45 and 46 enough to cause problems. The MOSFETs 45 and 46 (transistors) are the 2N7002 type, which have a switching speed of 20 nanoseconds. To measure capacitance down to 0.05 picofarads, first and second MOSFETs 45 and 46 must switch in less than 250 nanoseconds. The "on" resistance of MOSFETs 45 and 46 is a very small fraction of a percentage of the effective resistance. Thus, temperature variation has little effect on the measurement. Since the baseline resistance is fairly stable, a fixed voltage reference can be used in combination with a comparator to compare the output of the amplifier (stored in a capacitor), eliminating a need for an Analog to Digital or Digital to Analog converter. Any level greater than the baseline reference voltage is taken by the microprocessor as proof that the meter hand is over the pad being looked at (tested). If the meter hand is over two pads simultaneously (disposed midway between them), both will give a positive or high reading. A similar condition exists for the high pass filter technique of FIG. 3. In this event, the microprocessor is algorithmically programmed to decide which number the meter hand is pointing to by looking at the previously-read dial data stored in microprocessor 91.

As shown in FIG. 4, there is one pair of MOSFET-type transistors 45–46 and an additional third MOSFET type transistor (81–90). Transistors 45 and 46 are connected to each center electrode and to multiplexer 54 as shown. A third MOSFET transistor (81–90) is connected to each outer electrode 4–1 through 4–10. See leads 94–103. Each of the ten electrodes (pads) for each dial is connected to the other four dial's like numbered pads. All like numbered pads are connected to an electrode select MOSFETs (81–90) drain terminal. The electrode select MOSFETs source terminal is connected to ground, its gate or control terminal is connected to microprocessor 91. To reduce complexity, microprocessor 91 is used to control a single 74HC4051 multiplexer to connect the MOSFET pair 45–46 of the dial to be analyzed (XIO to H4) to the single stage current-to-voltage amplifier 55. Multiplexer 54 can be used so that up to eight dials can be hooked up selectively to amplifier 55.

Figure 6:
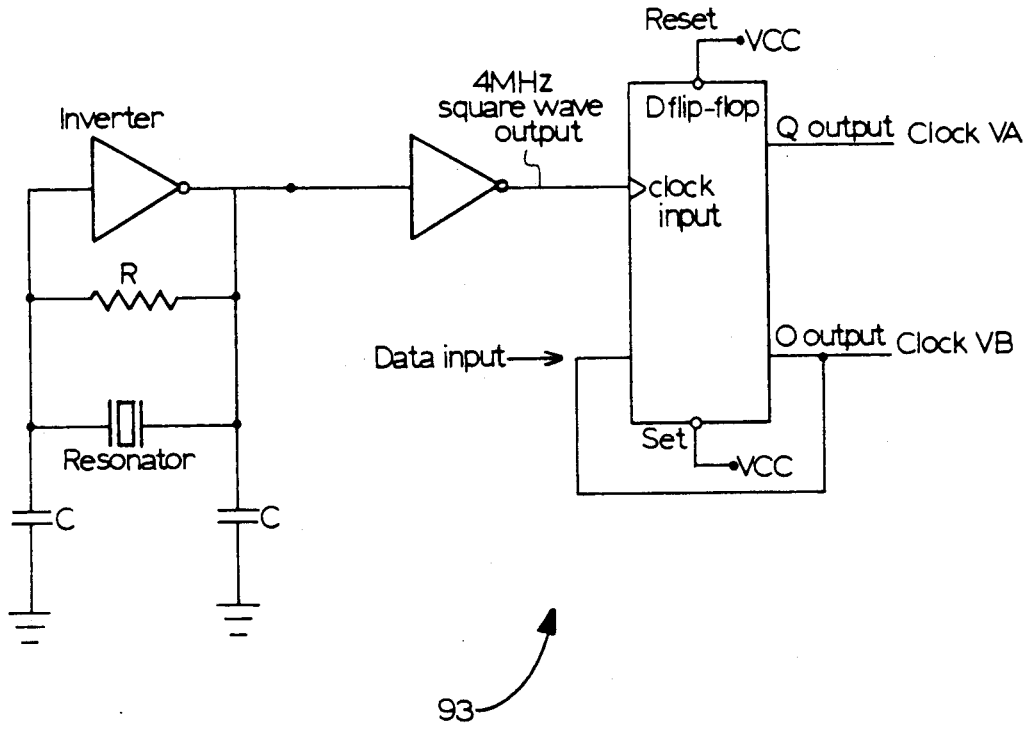
FIG. 6 is a schematic representation of a Dual Phase Clock used with the schematic of FIG. 4.

A high frequency square wave generator or clocks (see element 93 of FIG. 6) connected pins 47 and 48 (doubling as the clock for the microprocessor) is used to turn the electron valves (transistors) or MOSFETs (Metal Oxide Semiconductor Field Effect Transistor) 45 and 46 on and off. Initially, the encoder pad to be measured (or looked at) is grounded using the output port line of the microprocessor. A signal from clock 93 is fed into a D-Flip-Flop (see FIG. 6), connected in such a way to produce dual phase clock signals. One resulting clock signal is low, while the other one is high and vice versa for each one-half clock period. The two-clock signals may be referred to as VA and VB. VA is transmitted to the gate of the first MOSFET 45 and VB is transmitted to the gate of the second MOSFET 46. In the first one-half period of the clock, (a) VA is high and the first MOSFET 45 is turned on, allowing electrons to flow from its source to drain, and (b) VB is low and the second MOSFET 46 is turned off, restricting the flow of electrons from its source to drain. Since the first MOSFET 45 is wired to power (Vcc), and the other side is wired to the inner ring (central electrode) of the dial, electrons flow from power through the first MOSFET 45 and into the grounded capacitance formed between the pad, dial hand, and inner ring (center electrode) of the dial. In the second one-half period of the clock, VA is low and VB is high. Thus, the first MOSFET 45 is off, VB is high and the second MOSFET 46 is turned on. The second MOSFET 46 is connected between the inner ring of the dial and on one of the input pins of the multiplexer 54. The output of multiplexer 54 is connected by lead 60 to amplifier 55, configured with a simple resistive feedback. The input to amplifier 55 is a relatively low voltage, so that when second MOSFET 46 is turned on, the electrons are drained from the pad, meter hand, inner ring (center electrode) capacitance and the resultant current flow creates an analog voltage level output from amplifier 55. To move an adequate number of electrons, a fixed clock frequency of one to four Megahertz is required to measure capacitance levels of 0.05 to four picofarads, the variation in capacitance on the encoder board between pad and inner ring and pad, dial hand, and inner ring.

The pair of MOSFETs 45 and 46 and the variable capacitor form an approximation of a resistor. If the capacitance is small, little current can pass from power (Vcc) to the amplifier input voltage. Since the variable capacitor is filled up and emptied a fixed number of times in a given period of time, the small capacitance size limits the flow of electrons. If the capacitance is large, a large number of electrons flow through the amplifier. If the capacitance is low, a small number of electrons flow through the amplifier. Because a real and measurable current is flowing in one direction through the switched MOSFET system, any noise signals that are picked up by PC board traces can be easily shunted to ground through a simple RC filter. A more detailed description of the apparatus of FIG. 4 follows.

Figure 1:
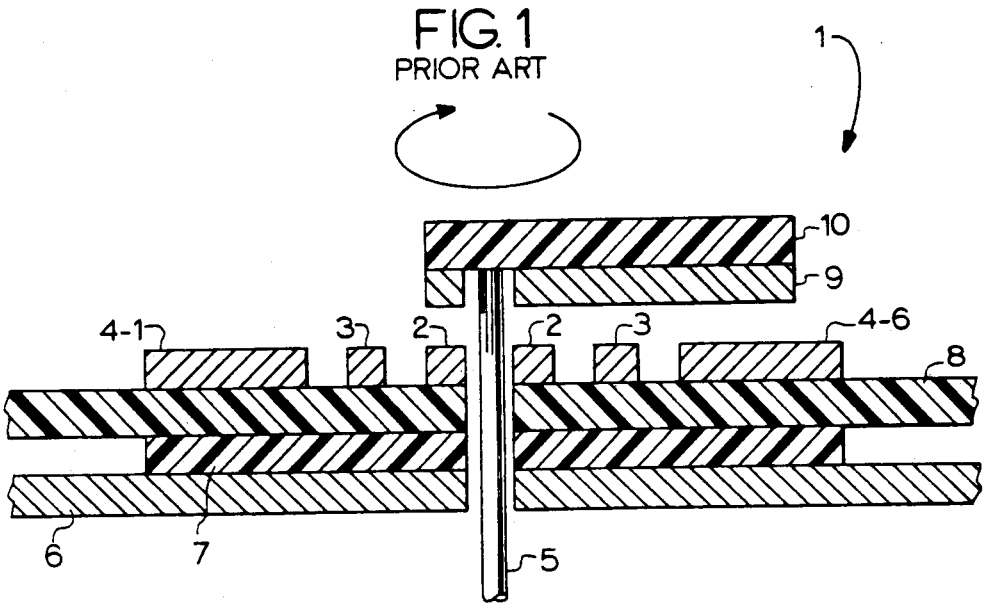
FIG. 1 PRIOR ART
FIG. 1 is a cross sectional view of a prior art excitable electrode (pad) array having a center electrode and a guard, all disposed between a meter dial face and a rotatable member (dial hand).
Figure 2:
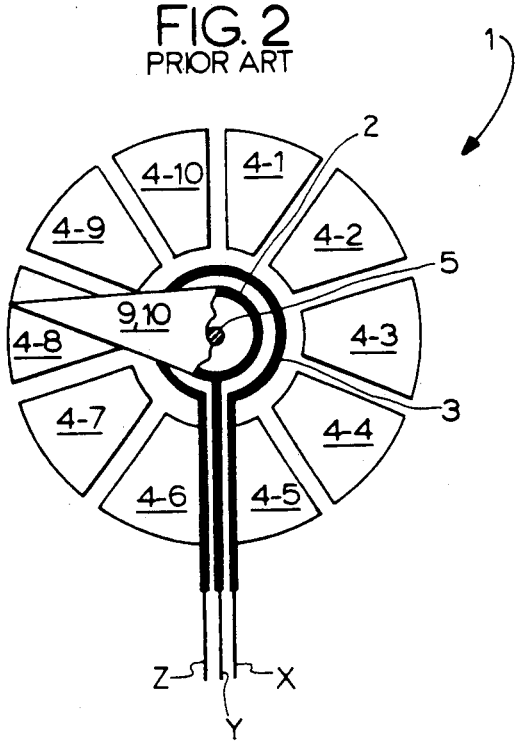
FIG. 2 PRIOR ART
FIG. 2 is a plan view of a prior art single electrode array including a central electrode and a guard.

The invention is shown by element 44 of FIG. 4. Five dials are contemplated, namely HO, H1, H2, H3, and H4. Each dial has essentially the same structure as that shown in FIGS. 1 and 2, but without electronic guard 3. Elements 4-1 through 4-10, being the outer electrodes. It is to be noted, however, that a single substrate may be used, replacing elements 6 and 7, such single substrate being made from FR-4 material. Central electrode 2 is not shown in FIG. 4 for the sake of clarity; however, it is to be understood that it exists. Elements 66 represent the dial hand. There are two MOSFETs 45 and 46 for each encoder dial combination (HO, H1, H2, H3, and H4). MOSFETs 45 and 46 are connected to the inner ring (center conductor 2) of each encoder dial by means of lead 59. MOSFET 46 of dial HO is connected by lead 49 to multiplexer 54. MOSFET 46 of dial H1 is connected by lead 50 to multiplexer 54. MOSFET 46 of dial H2 is connected by lead 51 to multiplexer 54. MOSFET 46 of dial H3 is connected by lead 52 to multiplexer 54 and MOSFET 46 of dial H4 is connected by lead 53 to multiplexer 54. Each MOSFET 45 of each dial is connected to a dual phase clock through pin 47 and each MOSFET 46 of each dial is connected to a clock through pin 48. MOSFET type transistors 81 to 90 are connected to dials HO to H4, outer electrodes, and to the microprocessor 91 and ground.

Multiplexer 54 is connected by lead 60 to amplifier 55, which is composed of resistor 71 bridging amplifier 80, resistor 72 and 73, plus noise reduction capacitor 104. Elements 72, 73 form a voltage reference circuit and simulates a ground for the amplifier 55. Resistor 71 is a gain set. Amplifier 55 is connected by lead 61 to low pass filter 56. Filter 56, composed of resistor 70 and capacitor 65, is connected by lead 62 to the negative input port of comparator 58. Ratio metric voltage reference device 57 is composed of resistors 69 and 67 and noise reduction capacitor 68. The positive input port of comparator 58 is connected by lead 63 to a ratio metric voltage reference (proportional to VCC) 57. The negative input port of comparator 58 is connected by lead 62 to the output of low pass filter 56. The comparator 58 output is connected to microprocessor 91 by lead 64. Microprocessor 91 would normally have 24 pins. The invention uses only 14, namely, 10 pins shown to the right of the words Pad MOSFET Select Control, 3 pins labeled "to Multiplexer Select" and one pin from the comparator 58. See lead 64. Having thus described the basic structure, the apparatus operates as follows.

Software in the microprocessor (not shown) controls the settings of the output port lines of microprocessor 91 and can hold them either high or low until another instruction changes their state. Three output lines are connected to the multiplexer 54, as above stated. Multiplexer 54 is connected to the five pairs of MOSFETs, namely, elements 45 and 46 of dials HO, H1, H2, H3, and H4, i.e., one for each dial. It will be noted that the multiplexer 54 can be connected to a maximum of eight pairs if necessary. Microprocessor 54 selects one of the MOSFET pairs by setting the three lines to a three binary bit code. To select pair one (dial HO), the microprocessor 54 would set the three multiplexer lines to 001, a code which corresponds to the first pair. Pair two of dial H1 would be represented by 010, etc. Multiplexer 54 makes a low impedance connection between the selected pair and the multiplexer output, connected to the input of amplifier 55.

Dial selection is held constant while the ten pads on the selected dial are individually selected. Normally, when an electrode or pad of an individual dial is not selected, microprocessor 91 will hold the corresponding Pad MOSFET's control pins or gates low to ground. The Pad MOSFETs with a low voltage applied to their gates maintain a high resistance between the Pads and Ground. Since the Pads have a high resistance to ground, very little charge can build up between the inner ring and the unselected Electrodes; the Electrodes are said to be floating. Like numbered electrodes are connected together so that a total of ten Pad Select MOSFETS 81 to 90 are needed for the entire encoder, there being ten electrodes on each dial. To select an electrode, the microprocessor will set high the output line connected to the Pad's Pad Select MOSFET. The high level is very close to Vcc; the Pad Select MOSFET turns on, connecting the Electrode through MOSFET 81 to 90 to ground. Once grounded, (or nearly so), the selected electrode/inner conductor capacitor can be quickly charged and discharged by the MOSFETs 45 and 46, which are connected to the dial's inner ring (center conductor). Since the other electrodes of the particular dial in question are floating, they are unable to form an electrode/inner ring capacitance that can be rapidly charged and discharged.

Current flowing through amplifier 55 will charge or discharge capacitor 65 of filter 56 until the voltage across capacitor 65 equals the average voltage level corresponding to the selected pad/inner ring's capacitance. The output of amplifier 56 will actively increase or decrease the charge on capacitor 65 to match the voltage developed by the current flowing through feedback resistor 70. Since there will be a period of adjustment as the voltage of capacitor 65 is driven to its new value, microprocessor 91 will ignore comparator 58's output for a set adjusted period. After such period has ended, the voltage across capacitor 65 corresponds to the electrode/inner ring capacitance. If the meter hand 9-10 is pointed directly at pad I on the selected dial, capacitor 65 would be driven to equal the voltage of amplifier 55's voltage reference applied to op-amp 80's positive input, minus the voltage potential across the feedback resistor 71.

To understand the above, it must first be realized that an average positive current is flowing through the MOSFET 45-46/capacitor system. The pad/inner ring capacitor first attracts a charge through MOSFET 45 from Vcc, a positive power, as the capacitance charges up. When MOSFET 45 is off and MOSFET 46 is on, the capacitance charge is attracted by amplifier 55's negative input, held at its reference voltage set by resistors 72 and 73, which is approximately one-half of Vcc. For example, when Vcc equals 5 volts, the reference voltage would equal 2.5 volts. The movement of the charge through the MOSFET capacitor system is directed through resistor 71, since input of amplifier 55 has a very high input impedance. This is to prevent appreciable current flow into the input of amplifier 55, which would create an error voltage at the amplifier's output. Typically, the input impedance between the negative and positive inputs is near 10 to the 12th power in ohms. The current flow through resistor 71 towards the output of amplifier 55 creates a voltage potential between the negative input and output of amplifier 55, with amplifier 55 driving its output to a lower voltage than the negative input. Amplifier 55 is capable of both sourcing and sinking current at its output to achieve the desired voltage. If less current were to pass through the MOSFET/capacitor system, then the voltage potential across resistor 71 would be smaller, which would correspond to a higher amplifier 55 output voltage. This relationship holds for all amplifiers in the negative feedback configuration.

The microprocessor's input line connected to the output of comparator 58 is scanned by the software to determine if it is either high or low. The results are stored in the random access memory. The previously grounded pad is allowed to float, with a high impedance to ground, by setting the microprocessor line, connected to the Pad Select MOSFET, 81 to 90 low. The next electrode on the dial is connected to ground through its Pad Select MOSFET, by setting the microprocessor line, connected to it, to a high voltage level. If all the electrodes on the dial have been read, multiplexer 54's select code is changed by the microprocessor to select the next dial on the encoder and then microprocessor 91 begins reading by again selecting electrode 4-I, electrode 4-2, electrode 4-3, etc. At all times, all MOSFETs 45-46 are attached to the D flip-flop, or other dual phase clock.

Once microprocessor 91 has a binary file corresponding to the recorded levels of all the dial's electrodes, it can algorithmically indicate the position of the meter hands 9-10. For example, if dial HO's responses were 0010000000 or 1101111111, depending on the connection of comparator 58's inputs, the meter hand could be said to be over pad 4-3. A 1 would correspond to a high response, a 0 would correspond to a low response. If the responses were 0000110000, then the meter hand would be said to be over two electrodes. These determinations would then be used to generate a five-digit number, (or one digit per dial), that could then be transmitted to an outside unit, and eventually sent to a utility.

Initially, both MOSFETs 45 and 46 are off. The microprocessor (not shown) is attached to microprocessor 91 output port pins as shown. MOSFET 45 is turned on by applying Vcc (positive DC voltage, typically plus 5 volts) to the MOSFET's gate. MOSFET 46 is turned off by applying less than one volt to its gate. Vcc is applied to the drain of MOSFET 45. This connection can be permanently wired. Since MOSFET 45 is on, current flows from the drain of MOSFET 45 to the source. The particular predetermined electrode, or outer electrode to be examined, is pulled down to ground by applying Vcc to the gate of the MOSFET, one of MOSFETS 81 to 90, whose drain is connected to the predetermined outer electrode. In order to analyze just one pad or outer electrode, the other electrodes of the dial are not connected through their respective MOSFETs to ground, all MOSFETS 81 to 90 except for the one which corresponds to the predetermined outer electrode, so that the electrodes cannot be charged and discharged. Inner ring (center electrode) is wired to the source of MOSFET 45. Current flows through MOSFET 45 from drain to source, charging the capacitor created by the center electrode, meter hand, and the particular electrode under investigation. The charging takes a very short time. MOSFET 45 is turned off and MOSFET 46 is turned on. Since MOSFET 45 is turned off, no current can flow from its drain to its source. MOSFET 46 has its drain wired to center electrode 2. MOSFET's 45 source and MOSFET's 46 drain are wired together, as well as to the center electrode of the particular dial. MOSFET's 46 source is attached to the negative input of op-amp 55, which has a simple resistive feedback. Op-amp circuit 55 provides a voltage less than Vcc at its negative input so that the charged center electrode can discharge through MOSFET 46, which is now turned on. The positive and negative outputs of the op-amp are always considered to be at the same voltage level. In this case the positive input is connected to a resistor voltage divider that provides a relatively constant reference voltage approximately one-half of Vcc. The inputs of op-amp 55 also have a very high input impedance so that almost no current flows into them.

The current flowing through MOSFET 46, as the capacitor formed by an outer electrode, meter hand, and center electrode is discharged, is routed through the op-amp 55's feedback resistor. Feedback resistor is wired between the negative input of the op-amp and the output of the op-amp. The flowing current causes a voltage potential difference between the negative input of op-amp 55 and the output of op-amp 55 and is proportional to the current flow due to the discharging of the center electrode, outer electrode capacitor. The above steps are repeated at the frequency of the dual phase clocks which are connected to the gates of the MOSFETS 45 and 46.

Current pulses through the feedback resistor of element 55 are smoothed out over many clock cycles by the resistor/capacitor low pass filter 56. The grounded capacitor of filter 56 charges up to an average voltage that equals to the voltage reference connected to the positive input of op-amp 55, minus the average voltage difference across the feedback resistor. The voltage of the grounded filter capacitor is the output voltage of the resistor/capacitor filter.

The output voltage of resistor/capacitor filter 56 is compared to another resistor divider's voltage reference at the input of comparator 58. The output of comparator 58 goes high (binary one) if op-amp 55 s output is greater than the reference. The output goes low (binary 0) if the op-amp's output is less than the reference. Reference is set just above the worst case baseline level, where the humidity is 95% and the meter hand is pointing to an adjacent pad, so that any op-amp output voltage above the reference gives a positive identification that a meter hand is located over at least part of the pad being analyzed.

Comparator 58's output is connected to microprocessor 91 so that results can be converted into a usable reading.

Filter 56 (composed of resistor 70 and capacitor 65) is used to smooth out the voltage output of op-amp 55, so that a roughly constant, steady voltage level is input to the comparator and compared to the comparator reference 57. Since a capacitor is used in the RC filter 56, there is a period of time that is required by the filter before the DC output voltage of the filter accurately corresponds with the DC input voltage. This period of time is referred to as the rise time or settling time of the filter. The output of filter 56 does not change by more than a few percent after the settling time has elapsed. Microprocessor 91 is programmed to wait for a time greater than the settling time before scanning the microprocessor input line connected to the comparator 58 output.

If the dial hand is above the selected outer electrode, the center electrode/dial hand/outer electrode capacitance will be large, the movement of charge into and out of the center electrode will be large, the resultant current applied to the input of the current-to-voltage converter 55 will be large, the current-to-voltage converter's voltage output will be large, after the filter 56 settling time the filter 56 voltage output will be large, and will be greater than the comparator voltage reference 57 so that the comparator output will be a low logic level. The low logic level is stored in memory for later reference by microprocessor 91.

If the dial hand is not above the selected outer electrode, the center electrode/dial hand/outer electrode capacitance will be small, the movement of charge into and out of the center electrode will be small, the resultant small current applied to the input of the current-to-voltage converter gives rise to a small converter voltage output, after the RC filter settling time the RC filter voltage output will be small, and will be less than the comparator reference so that the comparator output will be a high logic level. The high logic level is stored in memory for later reference by the microprocessor.

During the selection and deselection of each of the outer electrodes or pads, the dual phase clock 93 controls MOSFET 45 and 46, turning them on and off with a non-overlapping dual phase clock, two separate clocks, which have opposite logic states of each other, that are synchronized to a master clock or resonator.

If more than one comparator reference is used to compare filter 56 voltage output to, microprocessor 91 will activate analog switches (not shown) to apply them one at a time to one of the comparator inputs. Microprocessor 91 scans the comparator output and stores the high or low output voltage result in its memory after applying each voltage reference to the comparator input. After comparing the RC filter voltage output against each of many voltage references, the outer electrode is deselected by microprocessor 91. Microprocessor 91 applies a low voltage to its output line connected to the outer electrode's Pad Select MOSFET. The Pad Select MOSFET 81 to 90 turns off, in response to the low gate voltage applied by microprocessor 91, disconnecting the outer electrode from ground. The next outer electrode pad on the dial is selected by microprocessor 9!.

After all of the outer electrodes have been individually selected and the corresponding result(s) from the comparator have been read and stored by microprocessor 91, microprocessor 91 analyzes the data and determines the rotational position of the dial hand.

Multiplexer 54 may be a Motorola MC 74HC4051, OP-Amp 55 may be a Motorola MC 33172, Microprocessor 91 may be a MC 68HC705C8FN, and comparator 58 may be a Motorola MC 14575. Resistors 69 and 67 may have values of 806K and 1OOK ohms respectively and capacitor 68 may have a value of 0.01 micro farads. In RC filter, resistor 70 may have a value of 10K ohms and capacitor 65 a value of 0.001 micro farads. MOSFETs 45, 46 and 81 to 90 may be part number 1N7001 from Motorola. In its Dual Phase Clock 93 of FIG. 6, the capacitors may have value of 30 picofarads, the resonator may be a 4 megahertz ceramic type Murata Erie part number CSAC4.00 MGC, the Resistor have a value of one megohm, the invertors may be Motorola part number 74HC04 and the D-flip-flop Motorola part number 748C74.

What is claimed is:

1. An apparatus for remotely monitoring the'position of a rotatable member, relative to a substrate spaced apart from the rotatable member, as the rotatable member is rotated about an axis of rotation comprising:

(a) an array of spaced apart electrodes disposed on a surface of the substrate facing the rotatable member delimiting a center portion;

(b) a center electrode on said substrate disposed in said center portion;

(c) first and second transistors connected to said center electrode and to each other, said first transistor, when turned on, directing current to a predetermined electrode to form a charge to a variable capacitor formed by one of said electrodes, said center electrode and said rotatable member, and said second transistor, when turned on, directing current to a capacitor proportional to said charge on said variable capacitor;

(d) a switching device in contact with said first and second transistor for turning said first transistor on and off and said second transistor on when said first transistor is off and turning said second transistor off when said first transistor is on;

said capacitor, in electrical communication with said second transistor, for receiving said current from said second transistor and developing a voltage thereover; and, (f) a comparator, in electrical communication with said capacitor, containing a means for providing a reference voltage, for comparing said reference voltage to said voltage developed by said capacitor.

2. The apparatus of claim 1 wherein said first and second transistors are FET type transistors.

3. The apparatus of claim 1 further including a multiplexer in electrical communication with said second transistor and said capacitor.

4. The apparatus of claim 1 further including an amplifier in electrical communication with said second transistor and said capacitor.

5. The apparatus of claim 4 further including a multiplexer connected to said amplifier and to said second transistor.

6. The apparatus of claim 1 wherein said switching device is a dual phase clock.

7. The apparatus of claim 1 further including a third transistor connected to said electrodes.

8. The apparatus of claim 7 wherein said third transistor is a FET type transistor.

9. The apparatus of claim 7 further including a microprocessor, said microprocessor in electrical communication with said third transistor for selectively turnning on said third transistor.

* * * * *

UNITED STATES PATENT AND TRADEMARK OFFICE

CERTIFICATE OF CORRECTION

PATENT NO. : 5,030,950

DATED : July 9, 1991

INVENTOR(S) : John E. Veneruso

It is certified that error appears in the above-identified patent and that said Letters Patent is hereby corrected as shown below:

In Column 1, line 67, change "1301KHz" to -- 130KHz --.

In Column 5, line 36, after the word "noise", insert -- . The variable capacitor formed by the encoder's pads 4-1 -- .

In Column 12, line 49, insert -- (e) -- before the word "said".

Signed and Sealed this

Thirteenth Day of October, 1992

*Attest:*

DOUGLAS B. COMER

*Attesting Officer*

*Acting Commissioner of Patents and Trademarks*